US007296672B2

(12) United States Patent
Novacek et al.

(10) Patent No.: US 7,296,672 B2
(45) Date of Patent: Nov. 20, 2007

(54) WHEEL FOR DRIVING A FLEXIBLE HANDRAIL

(75) Inventors: Thomas Novacek, Schwechat (AT); Thomas Illedits, Neufeld (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/448,464

(22) Filed: Jun. 7, 2006

(65) Prior Publication Data

US 2006/0272923 A1 Dec. 7, 2006

(30) Foreign Application Priority Data

Jun. 7, 2005 (EP) ..... 05104963

(51) Int. Cl.
*B66B 23/06* (2006.01)

(52) U.S. Cl. ..... 198/335

(58) Field of Classification Search ..... 198/335, 198/336, 337, 331

See application file for complete search history.

(56) References Cited

U.S. PATENT DOCUMENTS 4,134,883 A * 1/1979 Mendelsohn et al. ..... 528/63
5,160,009 A * 11/1992 Iyoda et al. ..... 198/337
6,119,845 A * 9/2000 Song ..... 198/331
6,199,678 B1 * 3/2001 Reo ..... 198/330
6,457,573 B1 * 10/2002 Ostermeier et al. ..... 198/330
6,971,497 B2 * 12/2005 Illedits et al. ..... 198/330

FOREIGN PATENT DOCUMENTS

WO WO 2004/108581 A1 12/2004

* cited by examiner

*Primary Examiner*—Mark A Deuble
(74) *Attorney, Agent, or Firm*—Schweitzer Cornman Gross & Bondell LLP

(57) ABSTRACT

A wheel for driving a flexible handrail of an escalator or moving walk. The wheel has a power transmission element that can be turned about an axis of rotation and that has, on its circumference a contact surface through which an outwardly acting radial force can be exerted. The wheel also has two base sheaves that are arranged coaxially to the power transmission element. Each base sheave has a plurality of slits that are arranged in the outer edge area of the base sheave and extend toward the axis of rotation. The slits of one base sheave form, with the slits of the other base sheave, slit pairs. The wheel has a circumferential cover with an inside surface against which the contact surface of the power transmission element rests. A plurality of pins is arranged in the circumferential cover, each pin engaging a separate respective slit pair.

9 Claims, 2 Drawing Sheets

WHEEL FOR DRIVING A FLEXIBLE HANDRAIL

Figure 1:
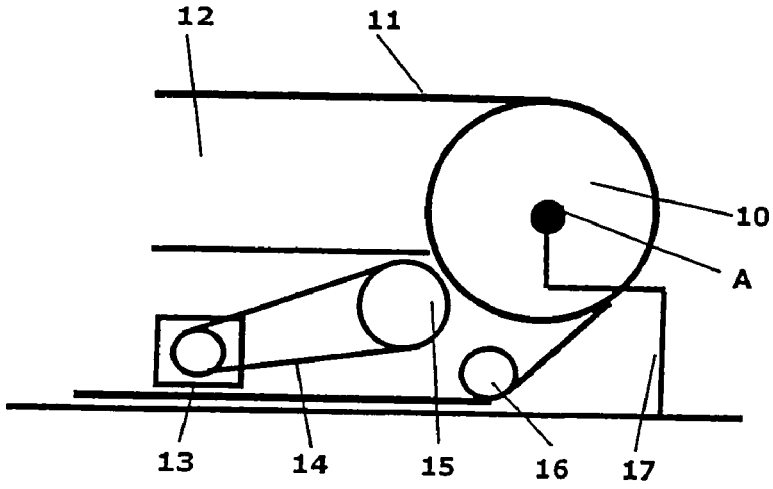

The present invention relates to a wheel for driving a flexible handrail of an escalator or moving walk.

BACKGROUND OF THE INVENTION

Escalators and moving walks generally have balustrades that are locationally fixed at their sides. Mounted on or against the balustrades are band-shaped handrails that move relative to the balustrades as synchronously as possible with the step elements of the escalator or moving walk. The handrails consist essentially of a flexible band and can be driven by a wheel that can itself be driven directly or indirectly by a motor. At the same time, the wheel can also serve the function of a diverter sheave to divert the handrail where a change of direction of the handrail is required.

The drive of handrails should be as smooth and continuous as possible, free of jerks, as quiet as possible, and the wheel as well as the handrail itself should be constructed in such a manner that noise and wear are minimized. In particular, so-called slip-stick effects should be avoided. Slip-stick effects are instability effects associated with parameters which affect the static friction and sliding friction between the handrail and the contact surface of the wheel that drives the handrail. To realize a continuous drive of the handrail, sliding of the handrail relative to the wheel should be avoided, which means that the static friction should not be less than a certain amount. In practice, however, it is common for brief periods of sliding friction to occur, which is comparable to aquaplaning and results in the slip-stick effect.

To prevent slip-stick effects, a known wheel for driving a handrail is executed essentially as a driving-wheel tire. The driving-wheel tire is filled with a filling agent such as compressed air or an inert gas. The driving-wheel tire acts as a power transmission element with its outer circumferential surface resting under pressure against the inner surface of the handrail so that on rotation of the driving-wheel tire the handrail is driven by the static friction acting between the power transmission element and the handrail.

Disadvantageous with such a driving wheel is, among others, the formation of bulges on the driving-wheel tire, which occurs as a consequence of its elasticity, as well as substantial wear of the tire through use.

It is accordingly an objective of the present invention to provide a wheel for driving a handrail of an escalator or moving walk with which the disadvantages of the prior art can be avoided.

BRIEF DESCRIPTION OF THE INVENTION

In accordance with the invention, a wheel for driving a flexible handrail of an escalator or moving walk, also known as a caterpillar wheel, has a power transmission element that can be turned about an axis of rotation. The cross sections of the power transmission element that lie perpendicular to the axis of rotation have circular enveloping curves whose centers lie on the axis of rotation. The approximately cylindrical area of the external surface of the power transmission element forms a contact surface that rests under pressure against the handrail and drives or moves the handrail along with it. The wheel also contains two base sheaves that are arranged coaxially with the power transmission element and have approximately the same diameter. On the side facing the power transmission element, each base sheave is provided with a plurality of cutouts. These cutouts are arranged in an outer edge area of the base sheave and are aligned toward the axis of rotation. The cutouts of the first base sheave along with the cutouts of the other base sheave form cutout pairs. The wheel has a plurality of pins, the ends of one pin always engaging in the cutouts of a given cutout pair. The pins are accommodated in an enveloping cover, which rests with at least a portion of its inner surface against the contact surface of the power transmission element.

The base sheaves hold the power transmission element under tension and prevent its lateral displacement. The power transmission element acts in the outward radial direction on the enveloping cover and holds the latter under tension against the handrail in such manner that the friction between the enveloping cover and the handrail is sufficiently high to uninterruptedly manifest itself as static friction, not interrupted by phases of sliding friction.

The pins increase the rigidity of the enveloping cover. An enveloping cover can therefore be selected which is relatively easily elastically deformable and which therefore rests closely against the handrail with no risk of bulge formation of bulges.

The power transmission element can consist of at least one gas-filled tire-like tube that is filled with flowable material, preferably a gas.

Alternatively or additionally to such a tire-like tube, the wheel can contain as the power transmission element one or more power transmission sheaves.

The two base sheaves are usually arranged axially on opposite sides of the power transmission element. The wheel can have further base sheaves that are arranged adjacent to, or with a gap between, the first-mentioned base sheaves. The base sheaves guide the power transmission element at its sides or grip the power transmission element and prevent its lateral displacement.

The power transmission element can be divided into several power transmission units, preferably in the axial direction. Adjacent power transmission units can be separated from each other by the further base sheaves, which can function as a power transmission element.

The cutouts of one cutout pair are usually executed identically and arranged in line with each other. Their shape can either match the ends of the pins or have somewhat larger dimensions so as to allow the pins a certain amount of play.

Especially to facilitate the installation and any necessary replacement of individual pins, it has proved advantageous to execute the cutouts as breakthroughs of the base sheave. It is preferable for such slit-like cutouts to start at the outer circumferential surface and to be directed toward the axis of rotation.

Important advantages of the new wheel include prevention of the slip-stick effect between the wheel and the handrail and prevention of bulge formation in the contact area of the wheel and handrail.

The slip-stick effect is essentially determined by the ratio of static friction and sliding friction between the enveloping cover of the wheel and the handrail. The type of friction essentially depends firstly on the coefficients of static and sliding friction between the materials of the cover of the wheel and the handrail; secondly on the pressure under which the enveloping cover of the wheel rests against the handrail; and thirdly on the extent of the contact surface.

The formation of bulges essentially depends on the respective rigidity of the material as well as the thickness of the material since, depending on these, bulges can form both in and perpendicular to the direction of motion and result in vibrations that create noise and wear.

If the slip-stick effect is avoided, the creation of noise is reduced to the extent that it depends on the energy that is freed on transition from static friction to sliding friction. If the formation of bulges is reduced, the creation of noise is reduced to the extent that it depends on the resulting vibrations. At the same time, wear of the respective components and the power required for driving are reduced while ride comfort is increased.

It is self-evident that, in addition to the shape given to the individual components, the selection of suitable materials is of great importance for the characteristics of the wheel. The base sheaves can consist of, for example, PE-HD, PA, or metallic materials. The pins can be made of a suitable metal or of PE-HD or PA. For the enveloping cover it is advantageous to choose an elastomer, NR, SBR, or HNBR, since with such materials a high coefficient of static friction can be attained. The power transmission element can take the form of a body made from an elastomer or fluid-pressure filled tire-like tube. Attention is expressly drawn to the fact that such materials are to be understood as merely illustrative of materials that can be used.

It is preferable for the wheel to be driven by a lantern pinion, such as shown in EP1464609. The lantern pinion engages in the step chain and turns the wheel which comes into contact with the handrail either on the upper surface or the lower surface of the handrail and moves the handrail. Alternatively the wheel can be driven by a conventional handrail drive unit such as a friction wheel.

BRIEF DESCRIPTION OF THE INVENTION

Figure 2:
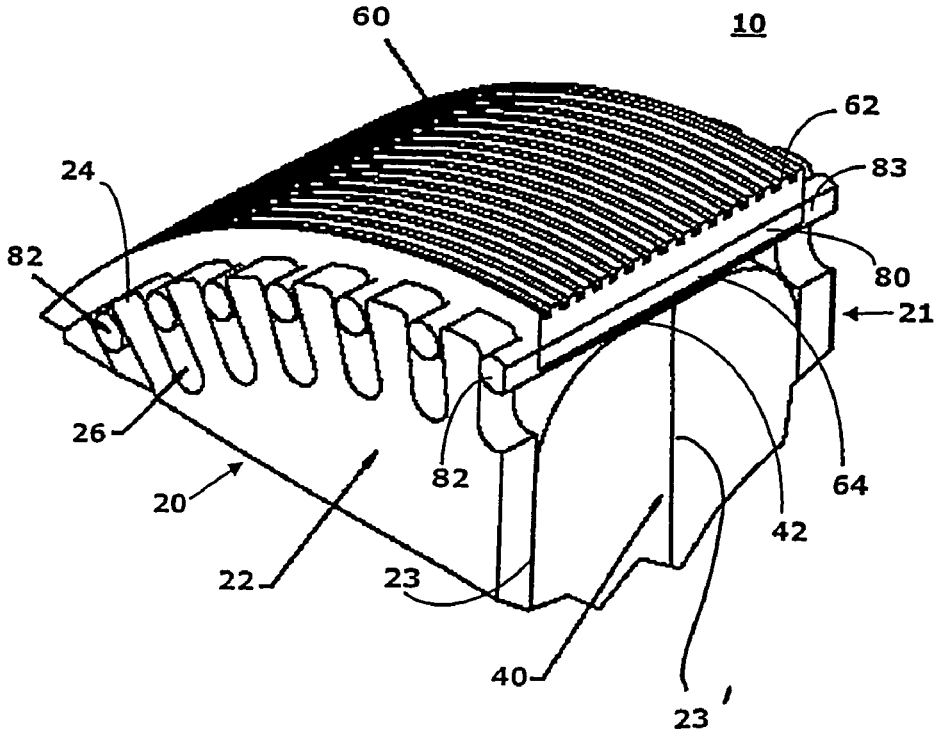
Figure 3:
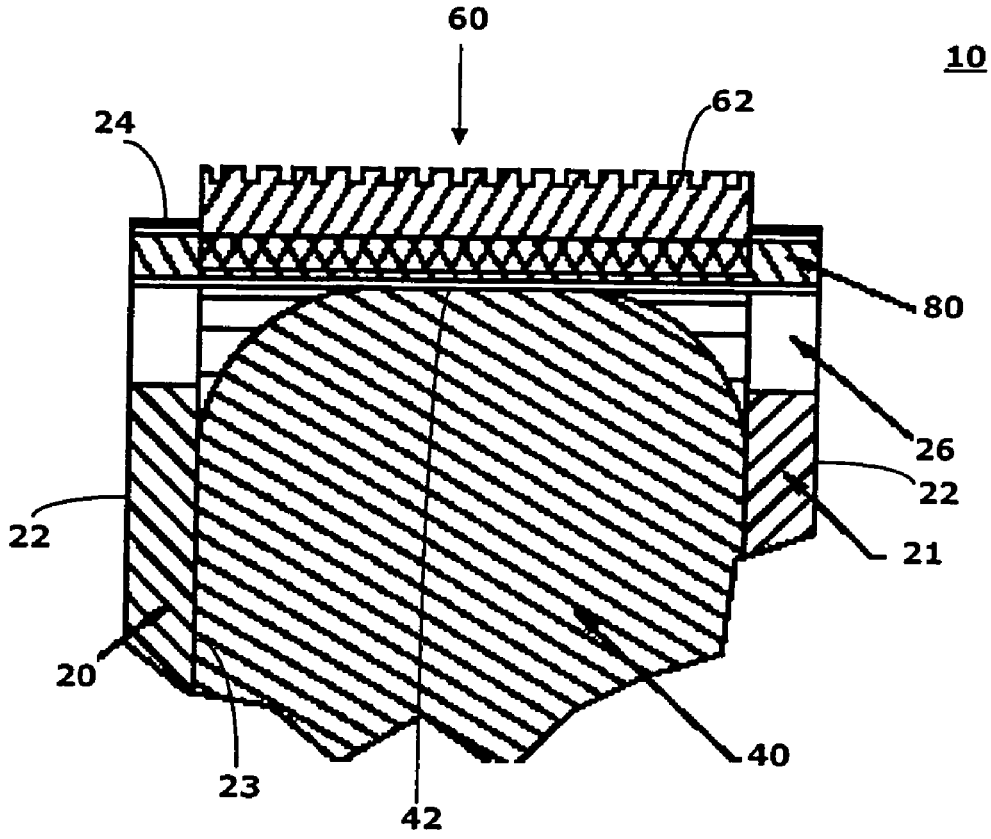

Further characteristics and advantages of the invention are explained below in relation to exemplary embodiments and by reference to the annexed drawings, wherein FIG. 1 is a highly simplified side view representation of a portion of a moving walk or escalator with a handrail that can be driven by means of a wheel according to the invention;

FIG. 2 is a partial diagrammatical representation of a drive wheel according to the invention; and FIG. 3 is a cross-sectional view of the wheel shown in FIG. 2, containing the axis of rotation.

DETAILED DESCRIPTION OF THE INVENTION

FIG. 1 shows a wheel 10 according to the invention that can be turned about an axis of rotation A and drives a handrail 11. The handrail 11 is located on the upper edge of a balustrade 12 that is arranged at the side of not-shown step elements of the escalator or moving walk. The handrail 11 lies longitudinally at almost 180° to the wheel 10. Drive of the wheel 10 takes place, for example, by means of a motor 13 via an endless element 14 and a drive wheel 15. A diverter pulley 16 is also provided for the handrail. The wheel 10 is fastened in a conventional manner to a locationally fixed supporting construction 17.

According to FIGS. 2 and 3 the wheel 10 has two base sheaves 20, 21, a power transmission element 40, an enveloping cover 60, and a plurality of pins 80. The wheel 10 can be either directly or indirectly motor driven and serves to drive the flexible handrail 12 of the escalator or moving walk, which is guided on the circumference of the wheel 10. The handrail 12 can overlap the side of the wheel 10 or embrace it.

Each of the base sheaves 20, 21 has two side sheave surfaces 22 and a circumferential surface 24.

In addition to the base sheaves 20, 21, one or more further base sheaves can be provided. For example, a further base sheave 23 can be arranged at a location, bordering on each of the base sheaves 20 and 21, or a further base sheave can be arranged centrally between the base sheaves 20, 21 at location 23'.

In the areas of their peripheral edges the base sheaves 20, 21 contain cutouts 26 that extend toward the axis of rotation A. These cutouts 26 take the form of slits that extend from the circumferential surface 24 of the base sheave toward the axis A. Each of the cutouts 26 of base sheave 20 forms, along with a cutout of the other base sheave 21, a cutout pair.

The cutouts need not be executed as breakthroughs through the sheaves but can also be executed as grooves in the inner side surface 22 of the sheave.

According to FIG. 1 the cutouts are arranged radially but they could also be at an angle to the radial direction which angle must self-evidently be considerably less than 90°.

In the present exemplary embodiment, the two base sheaves 20, 21 are formed identically and the slit-like cutouts 26 are also formed identically. The base sheaves 20, 21 are arranged in such manner that the cutouts 26 lie not only in register with each other but also lie parallel with the axis A so that rods 80, which extend into and are supported by the cutouts, can be straight. Other arrangements are, however, possible, with bent or bendable rods 80 being required for cutout pairs that are not connected by a line parallel to the axis.

Arranged or held between the base sheaves 20, 21 is the power transmission element 40. The power transmission element 40 has cross sections (in the end-face direction) that have envelopes of curvature that are circles whose centers lie on the axis of rotation A. On the circumference of the power transmission element 40 there is a contact surface 42 that is held under tension on the circumferential cover 60. In the present exemplary embodiment, not only are the enveloping curves circular but also are the entire cross sections, and the power transmission element 40 has approximately the form of a short cylinder.

The power transmission element 40 can be divided into two power transmission units. This is particularly advantageous if in total three base sheaves are provided that are separated from each other at a distance, such as by locating a central sheave at location 23' between sheaves 20 and 21. One power transmission unit is arranged between the base sheave 20 and the sheave at location 23', and the other power transmission unit is arranged between the base sheave 21 and the sheave at location 23'.

The power transmission element 40 shown in FIGS. 2 and 3 is executed as a tire-like tube that is filled with a fluid, gas, or other filling agent that is under pressure.

The enveloping cover 60 is made of a flexible elastic material and has on its outer surface ribs 62. In the radial direction the circumferential cover 60 projects outward beyond the base sheaves 20, 21. On its inside surface 64 the circumferential cover 60 is in contact with the contact surface 42 of the power transmission element 40 by which it is radially pretensioned in the outward direction. Furthermore, the circumferential cover 60 has cutouts extending inwardly from its inside surface 64 that, in the present exemplary embodiment, are aligned parallel to the axis of rotation A.

The pins 80 are accommodated in these cutouts and therefore are integrated to a certain extent into the circumferential cover 60. The pins 80 have ends 82, 83 that project from the circumferential cover 60 in the direction of the axis A and into the cutouts 26 of the base sheaves 20 and 21. The cross sections of the pins 80 all comprise identical circles but the pins 80 can also have other cross sections, and can also vary along the length of the pins 80.

If the cutouts 26 are slit-shaped, as shown in FIGS. 2 and 3, the pins 80 can project through the cutouts 26.

According to the invention, the pins 80 of the circumferential cover 60 along with the cutouts 26 of the base sheaves 21, 22, 23 form an interlocking connection for the purpose of converting a rotational motion of the base sheaves 21, 22, 23 into a rotational motion of the circumferential cover 60. Between the circumferential cover 60 and the inside surface of the handrail 11 a frictional transmission of power takes place. By means of this frictional connection, the rotation of the circumferential cover 60 is converted into motion of the handrail 11. The necessary press-on pressure between circumferential cover 60 and handrail 11 is essentially provided by the power transmission element 40 and can be changed by changing the internal pressure in the power transmission element 40. The grooves and slit-shaped cutouts 26 that run radially on the sheaves 21, 22 allow a certain movement of the rods 80 and therefore also of the circumferential cover 60 in the radial direction. By increasing the internal pressure in the power transmission element 40, the circumferential cover 60 can be moved radially outward along with the rods 80 so as to increase the press-on pressure applied to the handrail. The same effect can also be attained if rods 80 are used that are themselves flexible but cannot move radially in the area of the base sheaves 21, 22.

We claim:

1. A wheel for driving a flexible handrail of an escalator or moving walk, the wheel having a power transmission element that can be turned about an axis of rotation and having cross sections perpendicular to the axis of rotation have circular enveloping curves with centers lying on the axis of rotation and having on a circumference a contact surface through which an outwardly acting radial force can be exerted, the wheel further comprising:

two base sheaves arranged coaxially to the power transmission element, each base sheave having a plurality of cutouts arranged on a side of the base sheave that faces the other base sheave, the cutouts being located in an outer edge area of the base sheave and form, with the cutouts of the other base sheave, cutout pairs;

a circumferential cover with an inner surface that faces the axis of rotation and an outer surface upon which at least part of a contact surface of the power transmission element rests; and a plurality of pins arranged in the circumferential cover, a different one of the pins engaging in each cutout pair.

2. The wheel according to claim 1, wherein the power transmission element comprises at least one gas-filled tire-like tube that is filled with a flowable material.

3. The wheel according to claim 2 wherein the flowable material is a gas.

4. The wheel according to claim 1, wherein the power transmission element contains at least one power transmission sheave.

5. The wheel according to one claim 1, wherein the wheel has at least one further base sheave arranged between the two base sheaves.

6. The wheel according to claim 1, 2, 4 or 5, wherein the power transmission element is divided into a plurality of power transmission units.

7. The wheel according to claim 1, 2, 4 or 5, wherein the cutouts of a cutout pair are linearly aligned.

8. The wheel according to claim 1, 2, 4 or 5, wherein the cutouts are in the form of slits.

9. The wheel according to claim 1, 2, 4 or 5, wherein the cutouts start from an outer circumferential surface of the base sheave and extend toward the axis of rotation.

* * * * *